US011009233B2

(12) United States Patent
Satterley

(10) Patent No.: US 11,009,233 B2
(45) Date of Patent: May 18, 2021

(54) PORTABLE STOVE

(71) Applicant: Sean Satterley, London (GB)

(72) Inventor: Sean Satterley, London (GB)

( * ) Notice: Subject to any disclaimer, the term of this patent is extended or adjusted under 35 U.S.C. 154(b) by 139 days.

(21) Appl. No.: 16/307,067

(22) PCT Filed: Jun. 8, 2017

(86) PCT No.: PCT/GB2017/051669
§ 371 (c)(1),
(2) Date: Dec. 4, 2018

(87) PCT Pub. No.: WO2017/212278
PCT Pub. Date: Dec. 14, 2017

(65) Prior Publication Data

US 2019/0145625 A1 May 16, 2019

(30) Foreign Application Priority Data

Jun. 10, 2016 (GB) ..... 1610186

(51) Int. Cl.
*F24C 1/16* (2006.01)
*F24C 3/14* (2006.01)

(52) U.S. Cl.
CPC . *F24C 1/16* (2013.01); *F24C 3/14* (2013.01)

(58) Field of Classification Search
CPC ..... F24C 1/26; F24C 3/14
USPC ..... 126/40
See application file for complete search history.

(56) References Cited

U.S. PATENT DOCUMENTS

| | | | | |
|---|---|---|---|---|
| 5,992,407 | A | 11/1999 | Tsai | |
| 2004/0195238 | A1* | 10/2004 | Brija | A47J 36/06 220/254.3 |
| 2017/0231426 | A1* | 8/2017 | Barford | F23D 3/02 126/30 |

FOREIGN PATENT DOCUMENTS

| | | | |
|---|---|---|---|
| CN | 2 713 332 | | 7/2005 |
| FR | 825 296 | A | 2/1938 |
| JP | 63108128 | A * | 5/1988 |
| KR | 2006 0090475 | A | 11/2006 |
| KR | 200 442 415 | Y1 | 11/2008 |
| KR | 200442415 | Y1 * | 11/2008 |
| KR | 2014 0144825 | A | 12/2014 |
| KR | 20140144825 | A * | 12/2014 |

OTHER PUBLICATIONS

Kr200442415 Translation.*

(Continued)

*Primary Examiner* — Steven B McAllister
*Assistant Examiner* — Aaron H Heyamoto
(74) *Attorney, Agent, or Firm* — Charles C. Achkar; Ostrolenk Faber LLP.

(57) ABSTRACT

The present invention discloses a portable cooking stove comprising a base portion adapted to hold a heating means, and a removable top member for supporting a cooking implement, characterised in that the base portion comprises a support member for supporting the top member, the support member comprising a plurality of leaves, the intended lower edge of each vane being pivotally connected to the circumference of the base portion such that, in use, the leaves will extend upwardly from the base portion in order to support the top member, and when not in use, the intended upper edge of the leaves are pivoted towards the centre of the base portion.

7 Claims, 6 Drawing Sheets

(56) References Cited

OTHER PUBLICATIONS

PCT International Search Report issued in PCT/GB2017/051669 dated Oct. 4, 2017.
Written Opinion of the International Searching Authority issued in PCT/GB2017/051669 dated Oct. 4, 2017.

* cited by examiner

PORTABLE STOVE

The present application is a § 371 National Phase application based on PCT/GB2017/051669 filed Jun. 8, 2017, which claims the benefit of Great Britain Patent Application No. 1610186.7, filed Jun. 10, 2016, the subject matter of each of which is incorporated herein by reference in their entirety.

FIELD OF THE INVENTION

This invention relates to a portable stove.

BACKGROUND TO THE INVENTION

Portable stoves are used for camping or cooking in places where there is not a constant supply of fuel. Generally, portable stoves need to be lightweight and easily transportable. Existing portable stoves are often heavy or bulky and offer little wind protection for the heat source. Even existing lightweight stoves are prone to being bulky. Lack of wind protection can lead to difficulty in maintaining a heat source, and can also cause ignited fuel to blow out of the stove. Furthermore, existing stoves may be unstable on uneven ground. Generally, portable stoves do not provide an efficient heat source for cooking, with over 50% of the energy being wasted due to wind or lack of wind shield.

SUMMARY OF THE INVENTION

Accordingly, the present invention provides a portable stove comprising a base portion adapted to hold a heating means, and a removable top member for supporting a cooking implement, characterised in that the base portion comprises a support member for supporting the top member, the support member comprising a plurality of leaves, the intended lower edge of each leaf being pivotally connected to the circumference of the base portion such that, in use, the leaves will extend upwardly from the base portion in order to support the top member, and when not in use, the intended upper edge of the leaves are pivoted towards the centre of the base portion.

The stove described above finds particular use in the humanitarian aid, disaster relief market, being lightweight and compact, as well as being able to take a variety of fuels. One of the principal killers in the aftermath of a disaster is due to the spread of fires which start as unguarded cooking fires as well as due to smoke inhalation/carbon poisoning, especially where the fire is in an enclosed space, such as a dwelling.

Such an arrangement provides a portable stove that is easy to collapse to a convenient size for carrying. The pivotable leaves provide a shield against the wind, thereby allowing the stove to provide a relatively constant cooking heat, and at the same time allow the device to be compacted and packed away, thereby saving space when not in use. An "implement" is intended to mean a grill, hot plate, pan or similar item, on/in which food can be cooked. The top member maintains the shape of the stove, by holding the leaves in the open configuration, thereby buttressing it against wind or heat convection.

Preferably, at least one side edge of each leaf overlaps at least one adjacent leaf.

By having the leaves overlapping, the support member also functions as a wind shield to protect the heat source from adverse wind conditions. The overlapping forms a continuous wind-shield.

Preferably, the leaves comprise apertures.

These apertures allow air to flow to the heat source whilst the solid structure of the leaf still forms a wind shield. Channeling the air through apertures can take a lot of the velocity out of the air. Further, it allows for the introduction of air only where wanted, and the delimiting of quantities of air flowing through.

Preferably, the top portion comprises a fitting formed of a construction complementary to the size and shape of the structure created by the open leaf embodiment.

The top member secures the leaves in their open configuration, preventing outward or inward movement, and resultant loss of shape. The top member, by securing the leaves in their open position, creates a strong stove which supports the weight of implements. Preferably, the top portion comprises a plurality of sections connected by pivots. This provides the advantage of allowing the top portion to be folded or twisted into a smaller volume for storing.

Preferably the stove further comprises attachment means attaching, in use the top member and base of the stove.

More preferably, the attachment comprises at least one spring.

The attachment, which, it is particularly preferred, comprises a plurality of springs and serves to ensure that the support member is securely maintained between the top and base portions. The springs provide a compression fit, sandwiching the support member between the top member and the base of the stove.

Preferably, the stove is provided with legs; support legs fasten to the base portion to raise the base of the stove above the surface. By raising the base from the surface on which it sits, air can flow underneath the base and into the stove via apertures. Furthermore, heat damage to the ground surface can be reduced when the base is raised.

It is advantageous that the legs are height adjustable. The stove can be used on uneven ground by adjusting legs suitably, wherein each is adjustable independently of the others. The stove can thus be made substantially level on a sloped surface. Additionally, the airflow into the stove via the base can be adjusted by raising the stove above the ground.

In one embodiment the stove further comprises a conducting plate positioned on the top member. A conducting plate may be used to either place a pan on, or to cook the food on directly. A plate may be preferable to a grill, as, desirably the heat dissipates over the whole plate, providing an even heat, which provides a more efficient cooking method.

The invention further provides a support member for attachment to a camping stove, wherein the support member comprises a base portion and a plurality of leaves, the intended lower edge of each leaf being pivotally connected to the circumference of the base portion such that, in use, the leaves will extend upwardly from the base portion in order to support a top member, and when not in use, the intended upper edge of the leaves are pivoted towards the centre of the base portion to reduce the total size, for storage.

In certain embodiments, the folded leaves provide a space below their folded structure, as a result of their overlapping position, that can house a fuel source for later use. Such a support member may be attached to existing stoves, for example portable gas-stoves, to provide the benefits already cited. To overcome high winds interfering with the heat source, the present invention dissipates the wind around the stove, allowing only enough air to enter the stove to fuel the flame, without extinguishing it.

BRIEF DESCRIPTION OF THE DRAWINGS

The preferred embodiments of the invention will now be described, with reference to the accompanying drawings, of which.

DETAILED DESCRIPTION

Figure 1:
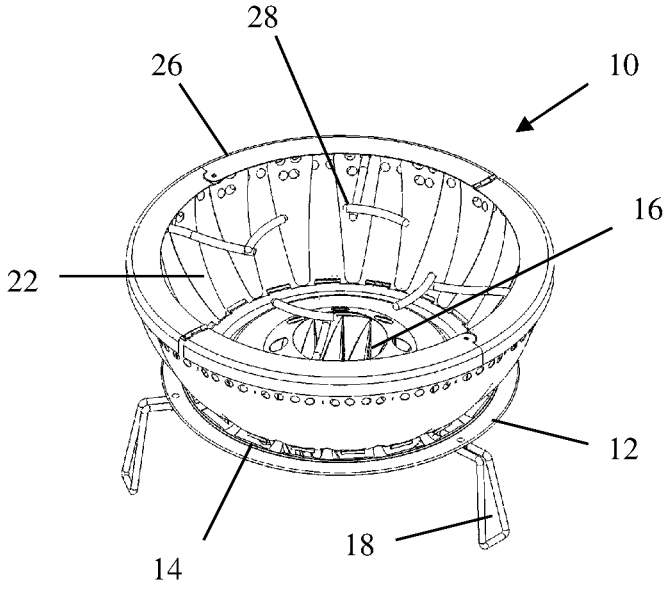
FIG. 1 is a diagram showing a perspective view of first embodiment of a portable stove according to the present invention, in an erected state.
Figure 10:
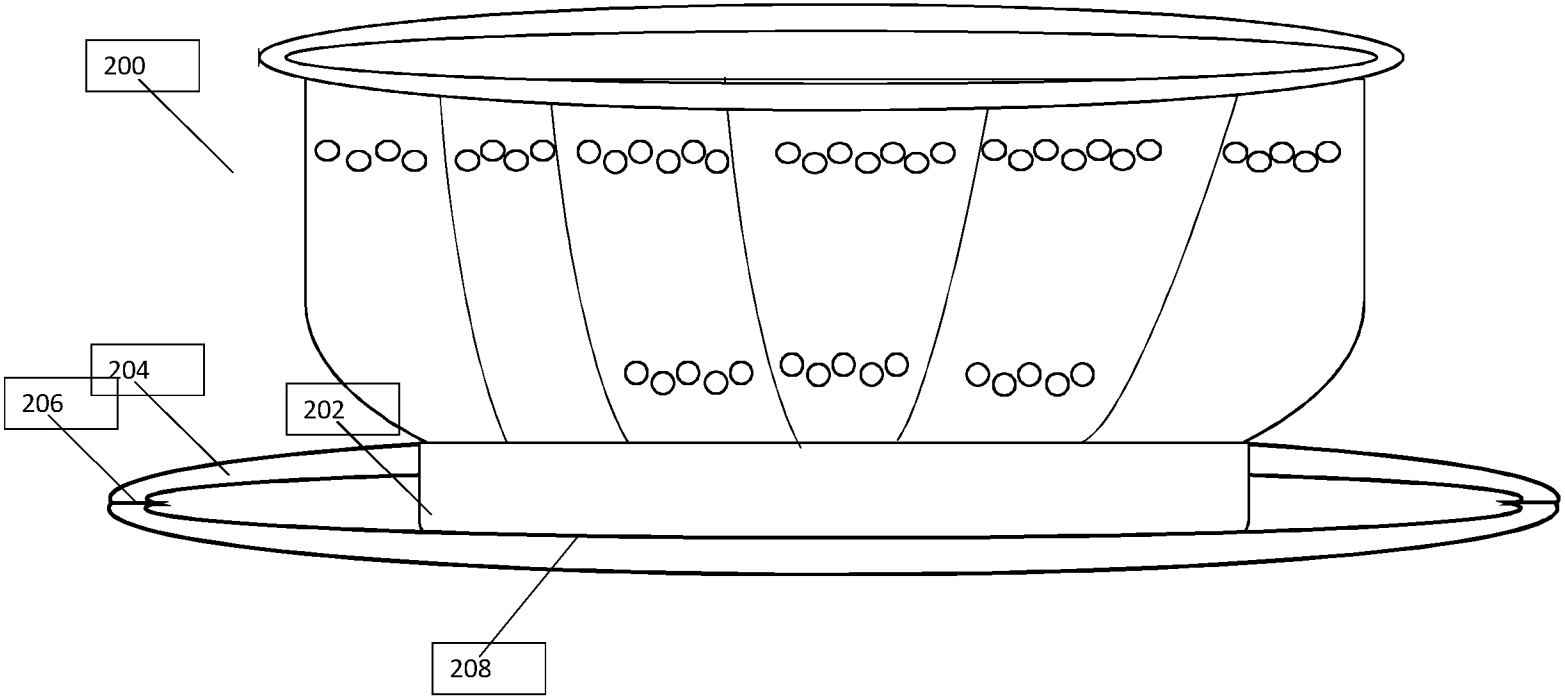
FIG. 10 is a perspective view of a third embodiment of the invention.

FIG. 1 shows a portable stove 10, comprising a base portion 12 in the form of a circular ring 14, having a fuel holder 16, which is suitable for holding solid, liquid or gel type fuels. In the embodiment of FIG. 1, the fuel holder 16 is shown as removable, or readily releasable, but in preferred embodiments, it is fixed into the centre of base portion 12. In the present embodiment, the base portion 12 is provided with foldable legs 18 and clips 20 for fastening of the legs 18 in an erected position. In the alternative, for example at FIG. 10, Stove 200 comprises base pillar 202, which attaches in use to lid 204 of adapted pot 206. The lid 204 has a pillar receiving central aperture 208 and is resiliently deformable such that it forms a frictional fit, in use, with the pillar 202. The aperture preferably comprises on or more inner lips (not shown) that increase the contact surface area with the fuel holder, thereby reinforcing the fit.

Figure 2:
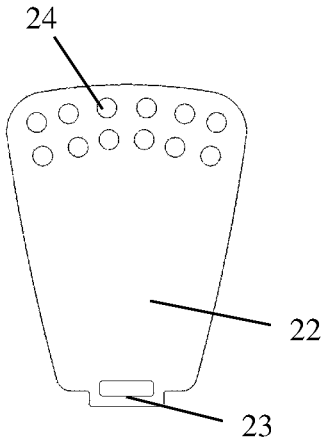
FIG. 2 is a diagram showing a single leaf of the portable stove of the invention.
Figure 3:
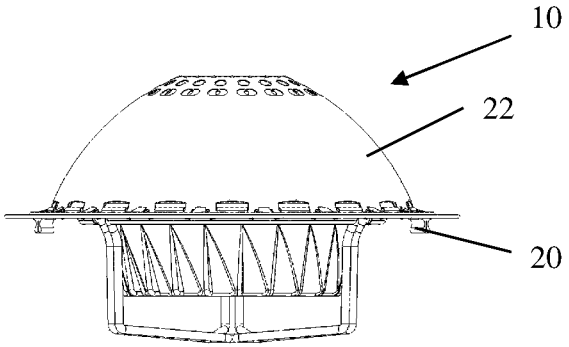
FIG. 3 is a perspective view of a first embodiments of the portable stove.

The base portion 12 has a plurality of pivotable leaves 22 connected around its circumference, constituting a support member. As shown in FIG. 2, the leaves 22 comprise an aperture 23 at their intended lower edge for connecting to the base ring 14 to form a pivot joint. The leaves 22 are shaped to diverge from the intended lower edge so that they have a wider intended upper end, and are provided with apertures 24 that run the length of each leaf. The leaves 22 are connected to form a circle such that when they overlap with adjacent leaves 22, with a first edge 22*a* on the inside of the circle, and the second edge 22*b* on the outside of the circle. The leaves 22 provide a continuous wind shield around the stove. In preferred embodiments, the leaves have air conducting apertures 24 at both the distal end of the leaves 22, as shown as FIG. 2, but also at the proximal end, adjacent to slot aperture 23. These proximal end apertures 24 can be seen at FIG. 12. The circle formed by leaves 22 is adjustable in circumference, such that it can be adapted to support different base sizes of pot or cooking vessel.

Figure 4:
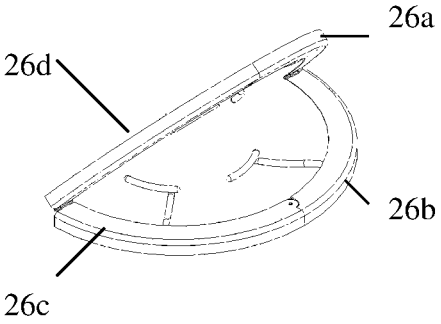
FIG. 4 is a diagram showing a perspective view of a top member of an embodiment of the stove.
Figure 5:
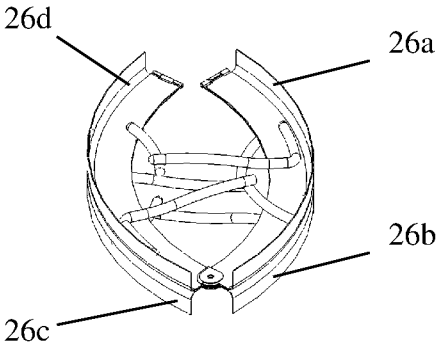
FIG. 5 is a perspective view of the top member of an embodiment of the stove.
Figure 11:
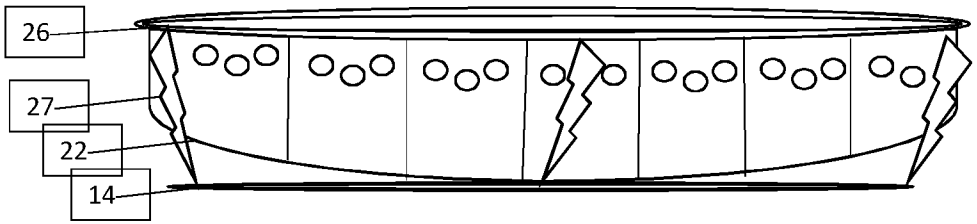
FIG. 11 is a perspective view of a third embodiment of the invention.

A top member 26, in the form of a ring, rests on top of the leaves 22 when they are substantially perpendicular to the base 12 when in use, that is, substantially vertical leaves 22. The top member 26 with an upper flat edge, comprises a lip 29 that extends below the top member 26, running circumferentially around the outer edge of the said top member 26. This prevents the top member sliding off, or being pushed off the upper portion of the leaves 22. The top member 22, in position atop the leaves 22, prevents the leaves 22 from moving out of shape, maintaining the stove's 10 ready-to-use, erected state. The top member can comprise either of a unitary, single piece structure, or of multiple pieces with hinged joins. As shown in FIGS. 4 and 5, the top member 26 comprises four quarter sections 26*a*, 26*b*, 26*c* and 26*d*. A first section 26*a* is hinged with a second section 26*b*, the second section 26*b* is pivotably connected to a third section 26*c*, the third section 26*c* is hinged to a fourth section 26*d*, and the fourth section 26*d* is pivotally connected to the first section 26*a*. The hinges allow movement of sections 26*a* and 26*d*, such that the ring 26 can be folded in half. When folded, sections 26*a* and 26*d* are folded on top of sections 26*b* and 26*c* respectively, the resulting shape being a half circle. The pivots provided between the second section 26*b*, third section 26*c*, fourth section 26*d* and the first section 26*a*, allow the top member to then be pivoted about a mid-point of the folded top member 26. This folding, as seen in FIG. 5, reduces the size of top member 26 for storage. As with the single piece top section, the sections 26*a*, 26*b*, 26*c* and 26*d*, all comprise a lip in the underside to engage the leaves 22, when is use, and prevent undesirable outward (away from the centre of the base ring 14) movement of the leaves 22, thus maintaining the shape of the stove, providing the stability to support a cooking implement. The top member 26, as shown in FIG. 11, can be connected by one or more connectors, which may comprise a spring 27 connection to the stove base portion 12. The springs 27 hold the top member 26 in contact with the leaves 22 by compressing and thereby drawing down the top member 26. The springs 27 also keep the top member 26 fastened to the base portion of the stove 10, keeping the stove 10 together, in use. Further elements can be used to retain the shape and circumference of the circle formed by petals 22, including a tie, band, cable or the like, which may simply wrap around or circumscribe the circle formed by the petals 22, or may be woven into the apertures 24 at the distal end of the said petals 22.

Figure 6:
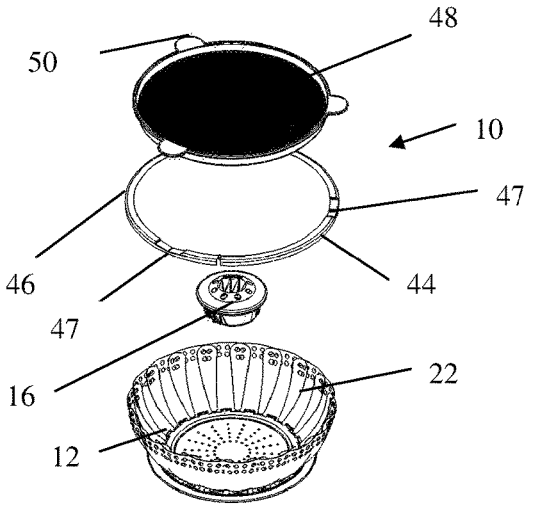
FIG. 6 is a perspective view of a further embodiment of the stove.

In one embodiment, the top member 26 further comprises support elements 28 in the form of a tubular section extending substantially perpendicularly from the top member 26 in an inward direction, that is, towards the centre of the top member 26 as shown in FIG. 6. The support elements 28 are of 'L'-shaped construction and are sufficiently strong to support the weight of a pan and contents for cooking.

In a further embodiment, the leaves 22 are constructed to be in close proximity to one another. This can be achieved by increasing the number of leaves 22 present on the stove 10, or by reducing the diameter of the fixing point onto which the leaves are connected to the base portion 12, at their hinged end. This tighter fit results in a friction fit between the leaves 22. The leaves 22 are resiliently deformable, with the friction fit maintaining the in use position of the leaves 22.

Figure 14:
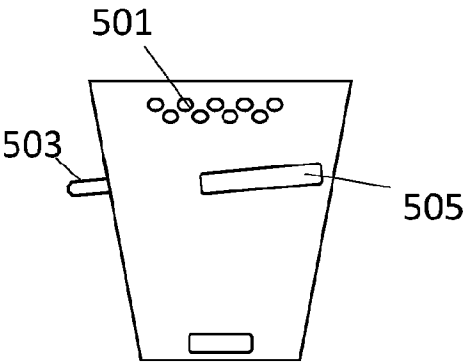
FIG. 14 is a perspective side view of an individual leaf of the invention.

In the further embodiment, shown in FIG. 14, the leaves 501 are so constructed to comprise a hook 503 and hook receiving aperture 505. Each individual leaf 501 comprises the hook 503 and hook receiving aperture 505, wherein the hook 503 can travel along the aperture length in folding and unfolding. The hook 503 locks into position on the leaf 501 wall when in stove 10 is in its open position, being forced into and retained in hook receiving aperture 505. The hook 503 can either be located on the edge of a leaf 501 wall, or protruding from either the front or rear panel. The hook receiving aperture 505 is within the leaf 501 wall, located at the opposite edge of the leaf 501 wall to that of the hook.

Figure 8:
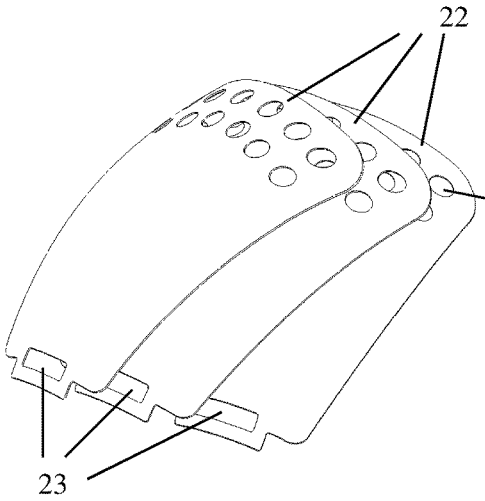
FIG. 8 is an enlarged partial view the leaves of the portable stoves of FIG. 1 and FIG. 6.

As shown in FIG. 8, when the stove 10 is not in use, the top edge of the leaves 22 are pivoted inwardly, that is, towards the centre of the base ring 14. The amount that the leaves 22 overlap is increased by pivoting them inwardly (see FIG. 9), and the overall volume of space taken up by the portable stove 10 is significantly reduced. At the same time as the leaves 22 are pivoted inwardly, in certain embodiments, the legs 18 feature a clip-lock mechanism that allows them to be unclipped from the clip 20 and pivoted underneath the base 12, to reduce the volume of space required for storing the stove 10.

A holding clip (not shown) may be provided for attaching the folded top member 26 to the collapsed portable stove 10 for more convenient storage. The infolded leaves 22 can provide a storage space, which may, for example, be used for the storage of fuel.

Figure 7:
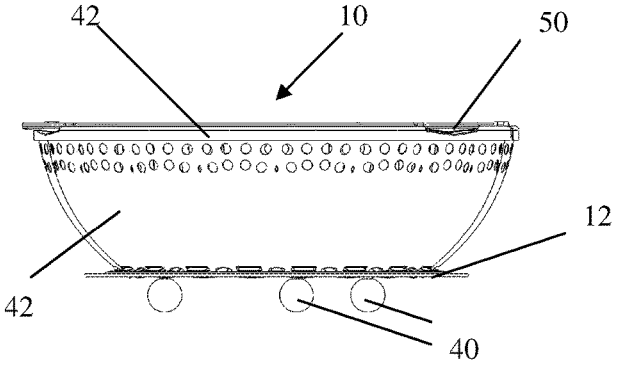
FIG. 7 is a perspective view of a portable stove according to a second embodiment of the present invention.

In a second embodiment as shown in FIGS. 7 and 8, the portable stove 10 comprises a base portion of a similar construction to that shown in FIG. 1. Feet 40 are provided in this embodiment of the present invention, in place of legs 18 of the first embodiment. The feet 40 are metal spheres attached to the intended underside of the base 12. A fuel holder 16 is provided within the base 12. Other preferred embodiments will have a fuel holder 16 integrated into the central portion of the base ring 14.

When in an erect position, ready for use, the leaves 22 are positioned in a substantially vertical orientation, and a top member 42 rests on top of the leaves 22. The top member 42 comprises two 'C' shaped portions 44 and 46, hinged at their ends to one another so that when the hinge is in an open position the two sections 44 and 46 form an 'O'-shaped ring. The sections 44 and 46 have a recess in their underside to allow engagement of the top member 42 with the leaves 22. By engaging the leaves 22, the top member 42 locks the leaves 22 from moving away from the substantially vertical position, reducing the likelihood of the portable stove 10 folding while in use.

The top member 42, as shown in FIG. 7, is provided with three indentations 47 on the intended top side. A conducting plate 48 with extensions 50 rests on top of the top member 42, with the extensions 50 resting in the indentations 47 on the top side of the top member 42. The conduction plate 48 is made from a material that can be heated by the burner and used to either cook on directly or on which a pan can be supported for cooking.

When the portable stove 10 is no longer in use, the top member 42 is removed and folded, the conducting plate 48 is removed, and the leaves 22 are pivoted inwardly as for the first embodiment so as to be more compact compared to the stove 10 when in use. A clip (not shown) may be provided on the base 12 for connecting the top member 42 to the base 12 for convenient storage.

Figure 9:
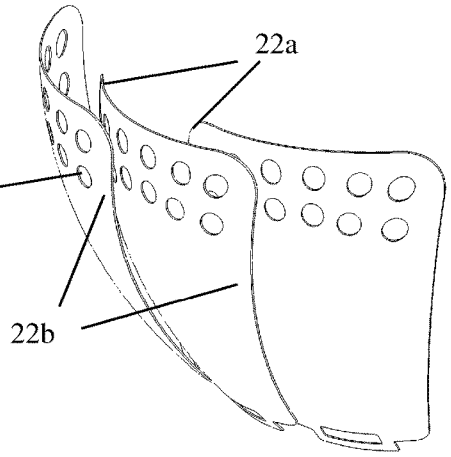
FIG. 9 is an enlarged partial view of the leaves of the portable stoves of FIG. 1 and FIG. 6.

FIGS. 8 and 9 show an enlarged view of the leaves 22, showing more clearly how they overlap, with the first side 22*a* on the inside of the circle of leaves and the second side 22*b* on the outside of the circle of leaves. FIG. 8 shows the leaves 22 in a 'closed' position, in which they are pivoted inwardly towards the middle of the base ring 14 (not shown in this diagram). FIG. 9 shows an enlarged view of the leaves 22 in an 'open', substantially vertical position, ready for the top member to be placed on top.

In the illustrated embodiments, apertures provided in the base and in the leaves 22 allow air to flow to the burner and allow combustion. In use, fuel is lit in the fuel holder 16 and that fuel is fed by air holes in the base, burner and in preferred embodiments, at the bottom of the leaves 22. Exhaust air and heat is emitted from the both the central circle formed by the leaves 22 and, where present the apertures running through the leaves 22 at their respective distal ends.

The legs 18 of the first embodiment and the feet 40 can be provided with means to allow independent adjustment, so that the legs can each be extended to different lengths. This allows the stove 10 to be stabilised on uneven ground. In a separate embodiment the legs 18 are replaced by the cooking pot lid 19 that provides support to the stove 10; by widening the base portion 12 contact with the floor. The lid 19 is secured by friction fit to the fuel holder 16.

Variations and modifications to the illustrated construction may occur to the reader familiar with the art without taking the device outside the scope of the present invention. For example, the stove may be adapted for use with a gas cylinder or other types of fuel, including wood and charcoal.

Figure 12:
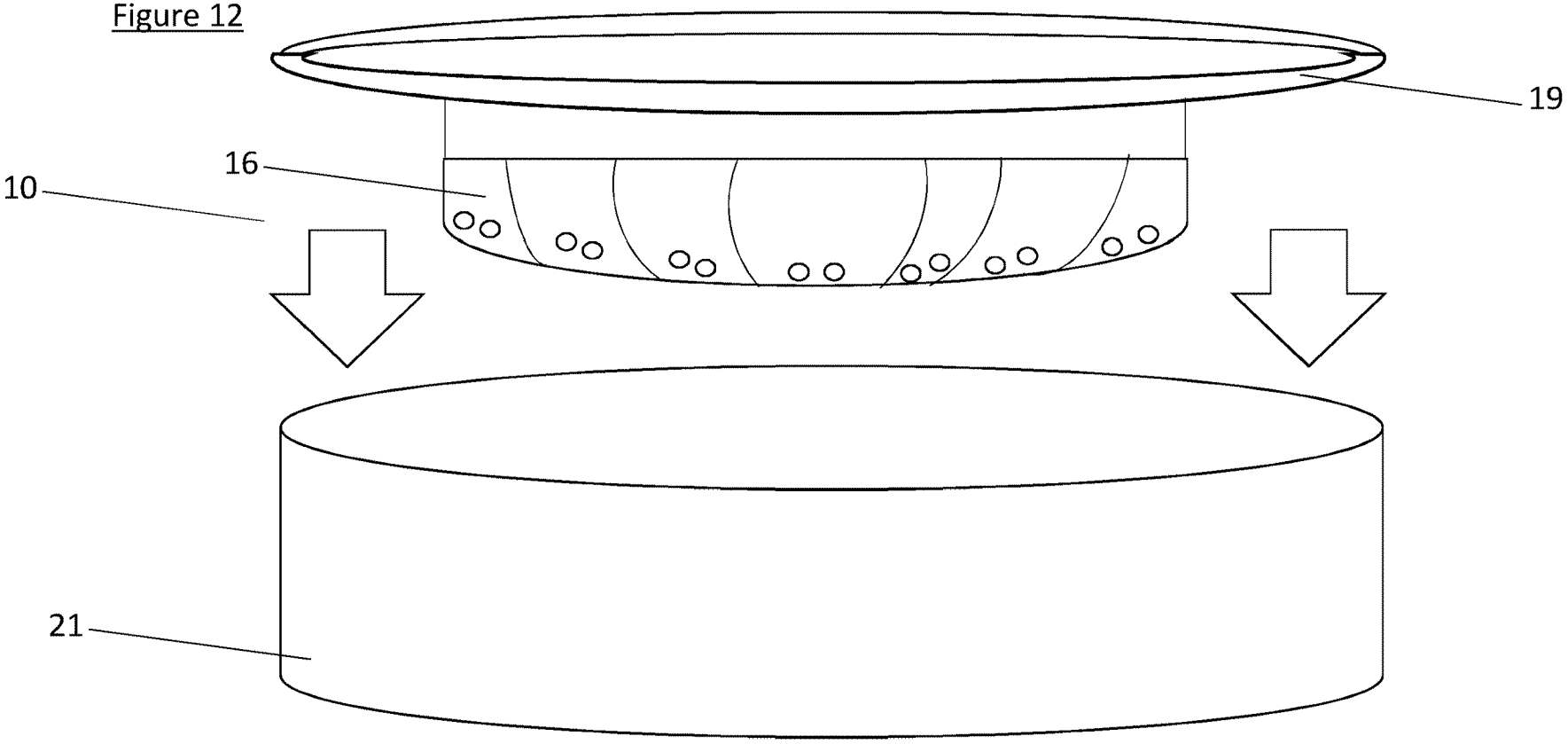
FIG. 12 is a perspective view of a third embodiment of the invention.

FIG. 12 shows the manner of storing the stove 10. The pot lid 19, by friction fit, supports the stove 10 in an inverted position, whilst the fuel holder 16, this forms the top of the storage container. The pot 21 forms the lower section of the storage by encapsulating the stove 10 within.

Figure 13:
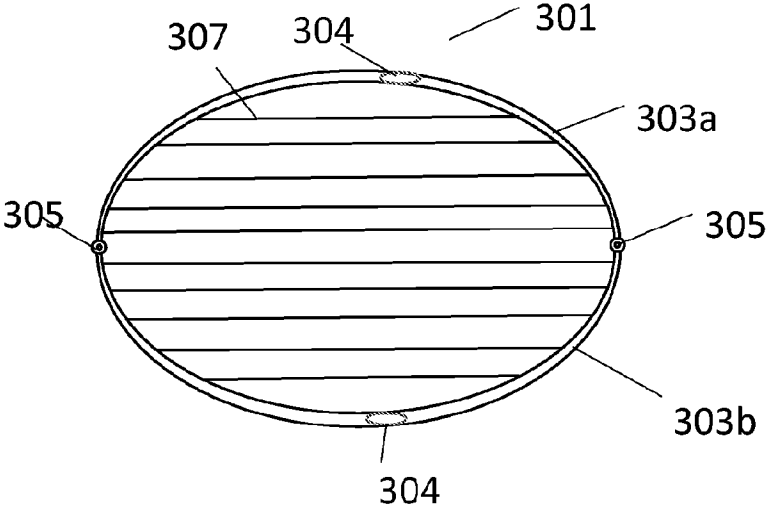
FIG. 13 is a top view of a further embodiment of the top ring of the invention.

FIG. 13 shows a further embodiment of top member 301. The top member 301 comprises two 'C' shaped portions 303*a* and 303*b*, the said portions being attached to one another via hinge 305 so that when the hinge 305 is in an open position the two sections 303*a* and 303*b* form a ring. The sections 303*a* and 303*b* each have a recess 304 in their respective undersides to allow engagement of the top member 301 with the leaves 22. By engaging the leaves 22, the top member 301 retains the leaves 22 in position, preventing the leaves 22 from moving away from the substantially vertical position. The top member 301 further comprises a series of spaced elongate bars 307 constitutive of a grill. Each individual bar 307 is attached at each end to an appropriate perimeter portion 303*a* or 303*b*. In the displayed embodiment the grill is constructed so that the individual bars are parallel to one another. In an alternative embodiment, the grill could be cross-hatched.

In a further variation of the top member, the top member is constructed from silicone. The silicone is resiliently deformable, and can be folded when not in use. The silicone top member has a recess in the underside to allow engagement with the leaves 22, in a similar fashion to the embodiments of FIG. 13.

Figure 15:
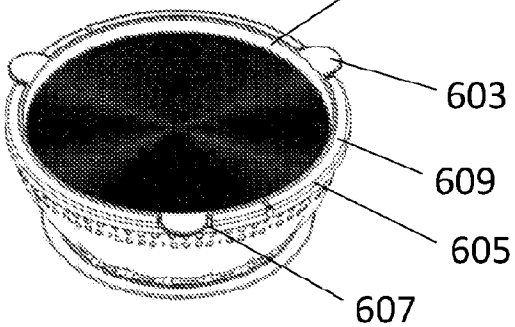
FIG. 15 is a perspective view of a further embodiment of the invention.

FIG. 15 shows a further variation of the top member 605. The top edge 609 of the top member 605 comprises at least one recess 607. In the displayed embodiment, the top member 605 comprises three recesses 607. The recesses 607, in use, receive lipped extensions 603 of a griddle plate

601. The recess 607 and lipped extension 603 interaction prevents movement of the griddle plate 601 on the top member 605.

The invention claimed is:

1. A portable stove comprising a base portion adapted to hold a heating means, and a removable top member for supporting a cooking implement, wherein the base portion comprises a support member for supporting the top member, the support member comprising a plurality of leaves, the intended lower edge of each leaf being pivotally connected to the circumference of the base portion such that, in use, the leaves will extend upwardly from the base portion in order to support the top member, and when not in use, the intended upper edge of the leaves are pivoted towards the center of the base portion;

and wherein, when the leaves are in the in use position, the top member is applied to the ends of the leaves that are distal from the pivotal connection between the leaves and the base portion, to retain the leaves in place and to provide support for the cooking implement;

wherein the top member is on top of the ends of the leaves; and wherein the ends of the leaves fit within a recess of the top member.

2. A portable stove according to claim 1, wherein at least one edge of each leaf overlaps at least one adjacent leaf.

3. A portable stove according to claim 1, wherein the leaves comprise apertures.

4. A portable stove, according to claim 1, further comprising attachment means attaching, in use the top member and base of the stove.

5. A portable stove according to claim 4, wherein the attachment comprises at least one spring.

6. A portable stove according to claim 1, wherein the top portion comprises a plurality of sections connected by pivots.

7. A portable stove according to claim 1, wherein the stove further comprises a conducting plate positioned on the top member.

* * * * *